United States Patent [19]

Brandt et al.

[11] Patent Number: 4,629,113

[45] Date of Patent: Dec. 16, 1986

[54] FURNACE CONTROLLER

[75] Inventors: Randy L. Brandt, Orange; K. H. Boswell, Mission Viejo; Robert A. Pett, San Juan Capistrano, all of Calif.

[73] Assignee: RHR, Inc., Anaheim, Calif.

[21] Appl. No.: 658,290

[22] Filed: Oct. 5, 1984

[51] Int. Cl.[4] ..... F24D 5/04

[52] U.S. Cl. ..... 236/10; 236/94

[58] Field of Search ..... 236/10, 11, 94, 9 A, 236/9 R

[56] References Cited

U.S. PATENT DOCUMENTS

| | | | |
|---|---|---|---|
| 3,726,473 | 4/1973 | Sapir | 236/11 |
| 3,844,475 | 10/1974 | Kesterson et al. | 165/26 |
| 3,921,899 | 11/1975 | Hamilton | 236/11 X |
| 4,295,129 | 10/1981 | Cade | 236/94 X |
| 4,299,554 | 11/1981 | Williams | 431/20 |
| 4,356,962 | 11/1982 | Levine | 236/11 |
| 4,373,662 | 2/1983 | Bassett et al. | 236/10 |
| 4,487,361 | 12/1984 | Brown | 236/11 |
| 4,537,345 | 8/1985 | Brown | 236/11 |

*Primary Examiner*—Harry Tanner

*Attorney, Agent, or Firm*—K. H. Boswell

[57] ABSTRACT

A device for augmenting the control of a forced air furnace includes a heat probe which is located in association with a furnace heat exchanger so as to sense the air temperature of air passing across the heat exchanger. The probe is connected via a buffer to an optical controlled switch. A latch is associated with both the probe and the switch such that in response to a high temperature turn off point the optical coupled switch shuts off the furnace solenoid associated with the furnace and maintains the solenoid in an off position until the probe senses a low temperature turn on point. Upon sensing the low temperature turn on point the solenoid is turned back on and is maintained in the on position by the latch until the high temperature point is again reached.

1 Claim, 3 Drawing Figures

FURNACE CONTROLLER

BACKGROUND OF INVENTION

This invention is directed to a control device for a forced air heating system which includes a heat probe responsive to the temperature of the discharged air of the furnace wherein the heat probe is connected to an optical coupled switch means which controls the gas flow to the furnace burner. More particularly, the heat probe includes an integrated circuit capable of sensing a high temperature and a low temperature whereby the fuel flow to the burner is shut off in response to the high temperature and is turned on in response to the low temperature.

For generations forced air furnaces were constructed to operate in essentially two modes. These were either off when no heat was needed or on when there was a demand for heat. In the on position the burner burned at its maximum rate at all times. In the days of readily available and cheap energy sources little consideration was given to the inefficiencies of these types of furnaces.

In more recent times with a enlightened awareness of finite fuel resources, steps have been taken to improve the efficiencies of forced air furnaces. While more modern and efficient furnaces are available for the consumer, because of the expense of these furnaces the consumer is not apt to replace the existing furnace unless the existing furnace becomes totally inoperable. The consumer presently then is caught between the high replacement costs of their existing furnace and the increasing costs of fuel to operate the same. As fuel costs escalate more and more, the pay back period for replacing an inefficient furnace will decrease, however, presently even in the face of increasing fuel bills the pay back time for replacing furnaces is still too long to warrant replacement of the same.

It has been recognized, as for instance, by the disclosures of U.S. Pat. Nos. 3,126,154; 3,921,899; 4,240,579; and 4,423,765 that modifications of the operation cycle of the existing furnaces can be made to make them more efficient. All of the above patents share in common the recognition that modifications can be made to existing furnaces to increase the efficiencies of these furnaces. However, before any of these devices will be widely accepted and therefore widely used by the consumer, the devices must be capable of ease of installation, adaptability to a variety of furnaces having different characteristics and capable of a long, useful service life equivalent to that of the furnace itself.

Certain of the devices described in the above mentioned patents utilize bi-metal strips and/or mechanical relays in their construction. Both of these require the use of contact points for completion of an electrical circuit. Unfortunately, bi-metal strips and mechanical relays which utilize contact points are subject to catastrophic failure. This is very evident by the inclusion in U.S. Pat. No. 4,240,579 of a breakage notch in its bi-metal strip and a flexible connector electrically connected on either side of the breakage notch which will allow for operation of the furnace in a normal manner, i.e., in the manner it operated before the adaption of the device to the furnace in case the bi-metal strip fails and breaks. Disclosed in this same patent is a method for sensing the temperature of the exhaust flue with modification of the burner operation made in response to the exhaust flue temperature.

U.S. Pat. No. 3,126,154 also utilizes bi-metal strips. Since the bi-metal strips of this patent are not located in the high temperature exhaust flue they are less prone to fail. However, the control device of this patent is, in effect, responsive to room temperature and not to direct operation of the furnace.

U.S. Pat. No. 4,423,765 does not rely on mechanical relays or the like for electrical switching control. It utilizes certain solid state devices. However, this patent as well as U.S. Pat. No. 3,921,899 relies on timing circuits to control the operation of the burner. In both of these the burner is turned off in response to sensing of a pre-determined temperature. However, the burner is not turned on in response to heat needs of the furnace, but instead it is turned back on in response to a pre-set time period. Because the weather patterns in a particular area may change from day to day and certainly change from season to season optimum cycle time for maximum efficiency of the burner coupled with adequate heat delivery also varies. Devices, therefore, which rely on burner operation dependent upon cycling times require constant monitoring and readjustment depending upon seasonal and short term weather variations and their corresponding variability on heat demand from the furnace.

BRIEF SUMMARY OF THE INVENTION

In view of the above it is evident that there exists a need for new devices which can be fitted to inefficient furnaces to increase the fuel efficiency of these furnaces. It is evident that there exists a further need for devices which allow for adaptability to a variety of furnaces of different manufactures and ages yet which are both simple in installation and operation such that they can be easily and conveniently installed and operated by the homeowner. It is further evident that if these types of devices are to be widely accepted that a need exists for a device which is capable of automatic operation without continued readjustment or recalibration or the like once installation is complete.

It is a broad object of this invention to provide a device fitting the criteria as outlined in the preceding paragraph. It is a further object of this invention to provide a device which is based solely on solid-state electronics and thus does not incorporate movable bi-metal strips, relays having points or the like or other antiquated electrical components which are subject to wear or ultimate mechanical failure. It is a further object of this invention to provide a device which, because of its simplicity of design is economical to the consumer and as such will result in a short pay back time to the consumer allowing the consumer to take full advantage of the operation of the device for achieving fuel savings.

These and other objects as will become evident from the remainder of this specification are achieved in a furnace system which comprises: a space heater having a burner means, a fuel valve means associated with said burner means and a heat exchange means for conducting heat from said burner to a space; a heat probe means, said heat probe means for sensing a first temperature and a second temperature, said heat probe means located in association with said heat exchange means; a control means electrically associated with said heat probe means for setting said first and said second temperatures; a optical coupled switch means electrically connected to said fuel valve means for controlling said fuel valve means, said switch means further electrically connected to said heat probe means so as to receive an electrical signal from said heat probe means in response to said first and said second temperatures; latch means electrically associated with both said heat probe means and said optically coupled switch means, said latch means for fixing said optical coupled switch means in a first switch position in response to said first temperature and in a second switch position in response to said second temperature.

In the illustrative embodiment of the invention the control means includes a first temperature setting means which is capable of setting the first temperature at at least two different values. Further, the control means includes a hysteresis means for setting a temperature differential between a first and second temperature whereby the second temperature is dependent on the first temperature. Additionally, the control means includes a variable setting means capable of setting the second temperature at at least two different values for each value of the first temperature.

In the illustrative embodiment a buffer means is electrically associated between the heat probe means and the optical coupled switch means. The electrical signal responsive to the first and second temperatures are received by the buffer means and in response thereto the buffer means operates the optical coupled switch means.

Further, in the illustrative embodiment a first indicator means is located in association with the optical coupled switch means to indicate when the switch is in a first position and further, a second indicator means is also in electrical association with the optical coupled switch means to indicate when the switch means is in a second position. This allows for ease of initial adjustment of the device when installed to the space heater.

In the illustrative embodiment the optical coupled switch means includes a MOSFET transistor means electrically connected to a photovoltaic means and further includes a light emitting means electrically isolated from the photovoltaic means and the MOSFET transistor. A light path is provided within the optical coupled switch means whereby in response to said heat probe means the light emitting means emits light which is sensed by the photovoltaic means and in response thereto the photovoltaic means generates voltage which is fed to the MOSFET transistor means to control the same.

Further, the above objects are achieved in an electronic controller which comprises: a power supply; a control circuit electrically connected to said power supply so as to receive power from said power supply; said control circuit including an optical coupled switch and a latch means; a solid state heat probe, said heat probe capable of sensing a first temperature and a second temperature, said heat probe electrically connected to said control circuit, said heat probe outputting an electronic signal to said control circuit in response to said temperature sensed by said heat probe; said optical coupled switch including an output circuit and an input circuit, said switch output circuit switched between off and on positions in response to signals received at said switch input circuit; said input circuit electrically connected to said heat probe; said latch means electrically connected to both said heat probe and said optical coupled switch; said optical coupled switch output circuit switched to said off position in response to an output signal outputted by said heat probe when said first temperature is sensed and said optical coupled switch output circuit switched to said on position in response to an output signal outputted by said heat probe when said second temperature is sensed, said latch means fixes said output circuit opticaly coupled switch in said off position in response to said first temperature and in said on position in response to said second temperature.

BRIEF DESCRIPTION OF THE DRAWINGS

This invention will be better understood when taken in conjunction with the drawings wherein.

This invention utilizes certain principles and/or concepts as set forth in the claims appended to this specification. Those skilled in the furnace manufacturing arts will realize that these principles and/or concepts are capable of being utilized with a variety of embodiments which may differ from the exact embodiment utilized for illustrative purposes herein. For this reason this invention is not to be construed as being limited solely to the illustrative embodiment but is only to be construed in view of the claims.

DETAILED DESCRIPTION

Figure 1:
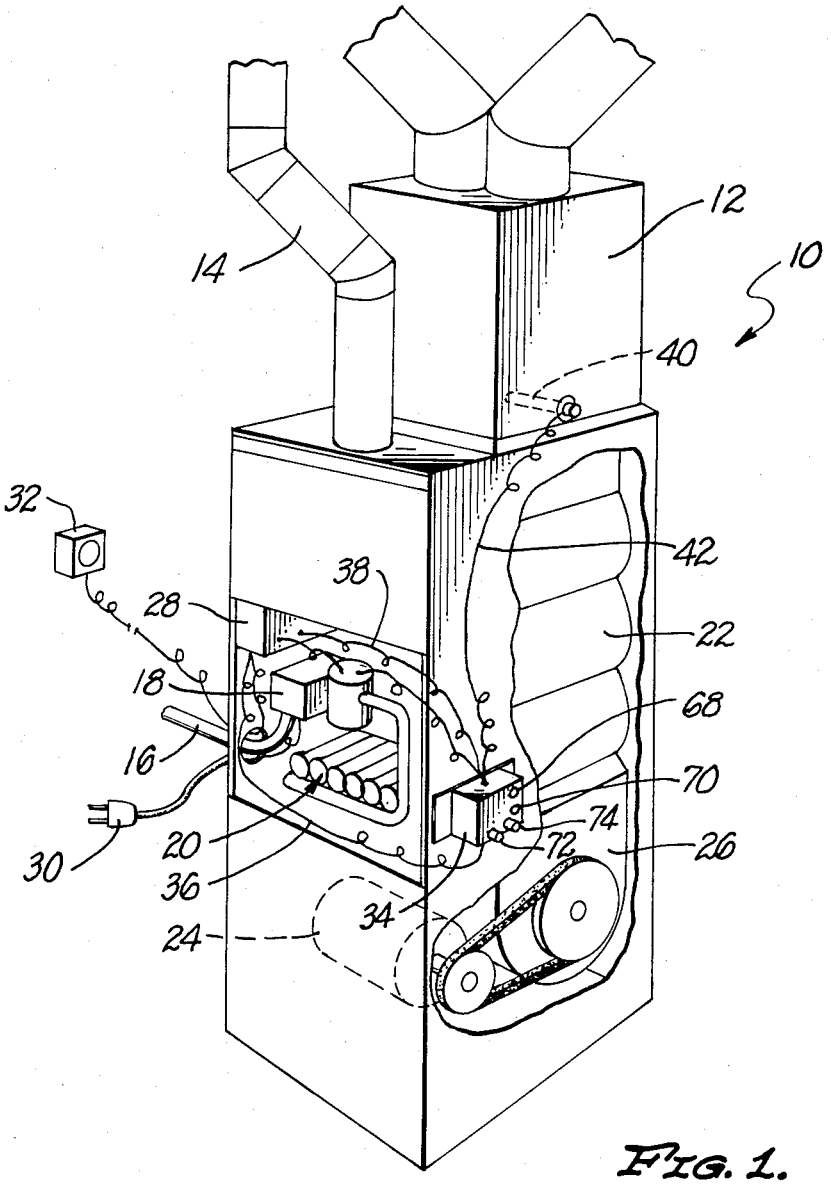
FIG. 1 is a diagramatical view of a furnace showing its main components as equipped with the invention.

In FIG. 1 there is shown a furnace 10 having a plenum 12 which conveys hot gasses to a space, such as a house or the like wherein the furnace 10 is installed as space heater. The furnace 10 includes a flue 14 through which discharge combustion gasses are channeled for expulsion to the environment. A gas line 16 feeds a gas supply to a control unit 18 which includes a gas solenoid hereinafter identified. Gas from the control unit 18 is fed to a burner 20 which heats up a heat exchanger 22. Exhaust gasses from the burner 20 after passing through the heat exchanger 22 are discharged out of the flue 14.

A motor 24 powers a blower 26 which passes air through the heat exchanger 22 and into the plenum 12. In passing through the heat exchanger 22 the air picks up heat from the heat exchanger 22 such that warm air is then discharged into the plenum 12 for feeding into the space which is to be heated.

An electrical control 28 is appropriately connected to an A/C source via plug 30. This supplies electrical current to the motor 24 as well as typically to a transformer with a secondary side that supplies 24 volts to a solenoid, hereinafter identified, which is located in the control unit 18. A thermostat 32 is located in the room or house to which the furnace 10 is connected. The thermostat 32 senses the temperature therein and turns the furnace 10 off and on in response to heating needs of the house, room or the like. All of the above components of the furnace 10 described are standard. Additionally, other components can be added to the furnace such as electronic ignitors and the like which contribute to energy savings for the furnace 10.

For the purposes of this specification a hot air gas fired furnace 10 is described. Alternatively an oil fired furnace could be utilized in conjunction with the invention except that certain controls would be substituted for the control unit 18, the burner 20 and the electrical control unit 28. Of course, an appropriate oil supply would be substituted for the gas line 16. For the purposes of the illustrative embodiment of this specification a hot air gas furnace will be described. When the invention is utilized in conjunction with an oil fired furnace appropriate control of the components in the oil fired furnace which correspond to the gas solenoid valve of a gas fired furnace would be utilized.

Further in FIG. 1 there is shown the main control box 34 of a furnace control device of the invention. It is electrically connected via electrical line 36 to the electrical control box 28 of the furnace 10. Normally the electrical control box 28 would include a transformer which would step down the A/C line current to approximately 24 volts. The electrical line 36 would be connected to the secondary side of this transformer so as to feed 24 volts A/C to the main control box 34. The main control box 34 further includes an electrical line 38 which is placed in series with the gas solenoid hereinafter identified which forms a portion of the control unit 18.

A plenum air temperature probe 40 is appropriately placed in the plenum 12 of the furnace 10. It is connected to the main control box via an electrical line 42. The tip of the probe 40 contains an integrated circuit, hereinafter identified, which appropriately senses the temperature of the air passing through the heat exchanger 22 into the plenum 12. In response thereto the main control box 34 includes certain components which shut the gas solenoid valve, hereinafter identified, of the control unit 18 off and on to modulate gas flow to the burner 20 irrespective of the fact that the thermostat 32 is signalling that the gas solenoid valve should remain in an on position.

Figure 2:
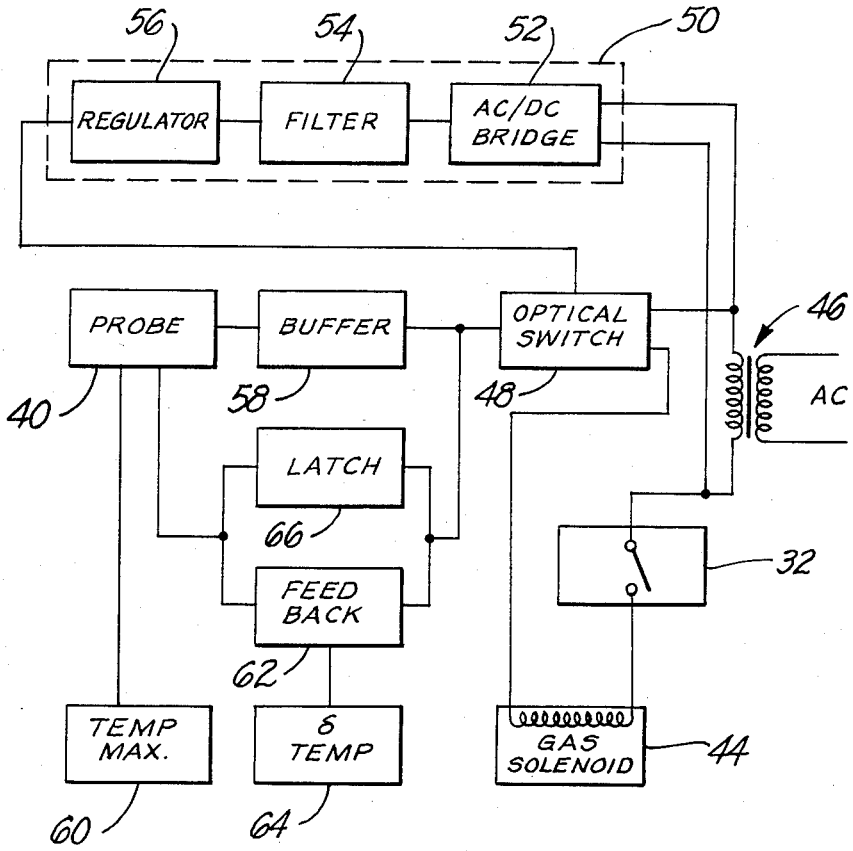
FIG. 2 is a block diagram of the operation of the invention.

Referring now to FIG. 2 the gas solenoid 44 is appropriately connected to the secondary side of transformer 46. As noted above the gas solenoid 44 forms a component of the control unit 18 and the transformer 46 forms a component of the electrical control box 28. The gas solenoid 44 is wired in series with an optical coupled switch 48, the details of which will be described hereinafter. Normally prior to installation of the components of this invention to the furnace 10 the gas solenoid 44 would be turned off and on via the thermostat 32. The thermostat 32 is shown as a switch in the block diagram of FIG. 2. When the device of this invention is adapted to the furnace 10 in conjunction with the thermostat 32, operation of the gas solenoid 44 also depends upon whether or not the optical couple switch 48 closes the circuit to the gas solenoid 44. In normal installations utilizing the invention, both the thermostat 32 and the optical coupled switch 48 would be placed in series with the gas solenoid 44.

Also attached to the transformer 46 is a power switch. The power supply 50 includes an A/C D/C bridge 52, a filter 54 and a voltage regulator 56. The power supply 50 ultimately supplies a low voltage D/C current to the remainder of the components of the invention. Normally this would be a 5 volt D/C current.

Electrically positioned between the probe 40 and the optical coupled switch 48 is a buffer 58. In response to a temperature within the plenum 12 the probe 40 outputs an electrical signal to the buffer 58. This signal is then communicated to the optical coupled switch 48. A temperature max control 60 is utilized to set a high temperature which the probes 40 will sense. When this temperature is achieved a signal is propagated to the buffer 58. In addition a feed back means 62 is wired between probe and the electrical connection between the buffer 58 and the optical coupled switch 48. The probe also senses a second temperature, a low temperature. This temperature depends upon a hysteresis which is set upon the setting of a differential temperature control device 64. When the probe 40 senses this second temperature, the low temperature, it will signal the optical coupled switch 48 to close the circuit to the gas solenoid 44 which activates gas solenoid 44 and restarts operation of the burner 20.

A latch means 66 is wired in parallel with the feedback means 62. The latch means 66 sets the optical coupled switch 48 positively in either an off or an on position in response to a signal from the probe 40.

Because the air moving through the plenum 12 can show instantaneous variations in its temperature, without the presence of the latch means 66 the optical coupled switch 48 can "chatter" in response to signals received from the probe 40. If the optical coupled switch 48 chatters the solenoid 44 also does. This results in an intermittant supply of gas to the burner 20 to first turn it on and then turn it off over a very short period of time. This is considered disadvantageous both to the operation of the furnace and to the lifetime of the gas solenoid 44. The presence of the latch means 66 eliminates this.

Figure 3:
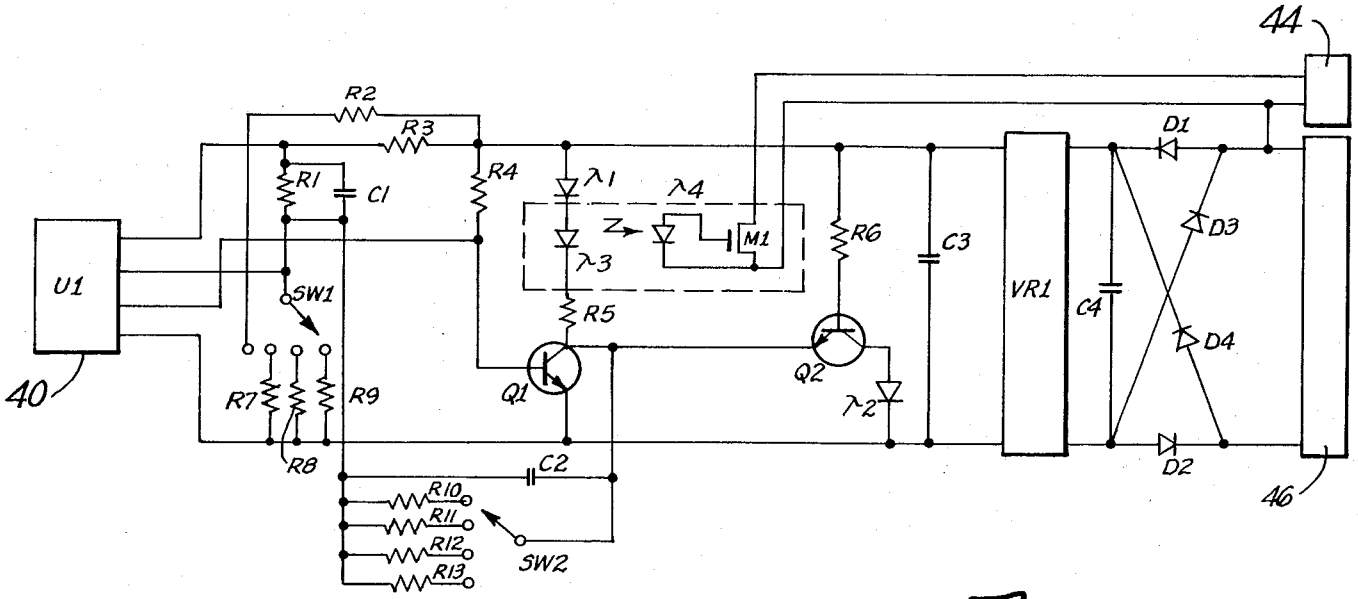
FIG. 3 is an electrical schematic of portions of FIG. 2.

Referring now to FIG. 3 and referring back to FIG. 2, the diodes D1, D2, D3 and D4 constitute the bridge 52. They are connected across the transformer 46. The capacitor C4 serves as the filter 54 with the voltage regulator VR1 and the capacitor C3 serving as the regulator 56. Current is supplied via resistor R3 to the probe U1. The switch S1 including its resistors R7, R8 and R9 serve as the temperature max control 60 with the switch S2 including its resistors R10, R11, R2 and R13 serving as the differential temperature control switch 64. The capacitor C2 serves as the latch means 66 and Q1 is the buffer 58.

Resistor R1 and capacitor C1 are a bias resistor and a noise filter respectively feeding the switch S1 and switch S2. The switch S1 includes a dead or off position which is connected through resistor R2 to limit current to this position. When it is desirable to maintain the solenoid 44 in a closed position the switch S1 is switched to the off position. The optical coupled switch 48 is wired in series with a diode λ1 which serves as a first indication light 68. A further transistor Q2 is wired to diode λ2 which serves as a second indicator light 70. Both of these are visible on the main control box 34. When the first indicator light 68 is lit it indicates that the solenoid 44 is open feeding gas to the burner 20 and when the second indicator light 70 is lit it indicates that the solenoid 44 is closed and no gas is being fed to the burner 20.

The optical coupled switch 48 includes diode λ3 which emits light in response to current flow through it. This light is sensed by photovoltaic λ4 which activates the MOSFET transistor M1. The MOSFET transistor is placed in series between the solenoid 44 and the transformer 46 to control current flow through the solenoid 44. Therefore in response to light emission of diode λ3 the gas solenoid is turned on. The optical coupled switch 48 can be an OMA 221 available from Theta Jay Corporation, Wakefield, MA.

The probe 40 is an LM 3911 temperature controller available from National Semiconductor. It is connected to switch 1 which include the resistors R7, R8 and R9. These are chosen in value such that the probe 40 is capable of sensing at least 2 and, as shown in the illustrative embodiment, 3 individual high temperatures corresponding to the temperature of the air emitted from the gas exchanger 22 into the plenum 12. By selection of the position of S1 which is connected to a control knob 72 on the main control box 34 the appropriate resistor R7, R8 and R9 is put in circuit with the probe 40. This sets the high temperature turn off point of the gas solenoid valve 44 with respect to the air passing through the plenum 12.

The switch S2 is connected to a further control knob 74 also located on the main control box 34. The switch S2 is set to put one of the resistors R10, R11, R12 or R13 in circuit in parallel with the latch capacitor C2. This sets a temperature differential between a high temperature turn off point governed by switch S2 and a low temperature turn on point governed by the particular resistor R10, R11, R12 or R13 of switch S2. It is evident that for any one position of switch S1 as, for instance, resistor R7 there are four positions for switch S2. Because of this for every high limit temperature turn off point for the solenoid valve 44 there are four individual and different low temperature turn on points for the valve 44. As such a range of temperature differentials between the point of turning the gas off and the point of turning the gas on for the solenoid 44 is available for the operation of the furnace 10. In certain climatic situations it may be desirable to have the turn off and turn on point of the gas solenoid very close because of increased gas needs in very severe weather. In more moderate weather it may be desirable to have the temperature differential between the turn off point and the turn on point broader in order to conserve more fuel.

Different furnaces depending upon their manufacturers and when they were manufactured have different heating characteristics. Thus one furnace may output temperature at a first temperature whereas another furnace outputs temperature at a different, as for instance a much lower temperature. By appropriately selecting switch S1 to operate within the temperature range of the particular furnace and adjusting switch S2 to the climatic conditions the furnace 10 can be individually set both to its own characteristics and the climatic characteristics for a more efficient operation.

Prior to reaching the turn off point current is conducted through both λ1 and λ3 through the collector of Q1. λ3 thus emits light to photovoltaic λ4 which maintains the MOSFET transistor M4 in an on condition holding the solenoid 44 in an on condition allowing gas to flow to the gas burner 20. When the probe 40 senses the high temperature based upon the position of S1 the collector of Q1 goes high which in turn sets the emitter of Q2 also at high. The current is no longer conducted through λ1 and λ3 closing the switch 48 and turning off the first indicator light 68. However, current is now diverted through R6, through λ2 to light up the second indicator light 70 indicating that the solenoid gas valve 44 is closed.

When the low temperature point as set by the switches S1 and S2 discussed above is sensed by the probe 40 the collector of Q1 goes low consequently causing the connector of Q2 to also go low. Current is thus shut off through λ2, but reinstigated through λ1 and λ3 to light the first indicator light 68 and concurrently turn the switch 48 on which also turns the solenoid valve 44 on.

By utilization of this invention in conjunction with the furnace 10 the solenoid valve 44 is first turned on allowing the burner 20 to heat up the heat exchanger 22 to a pre-set temperature. While the heat exchanger 22 is in the process of absorbing heat, heat is also transferred via the plenum 12 to the appropriate space which is being heated. When the probe 40 senses that the air passing through the plenum 12 is at a particular high temperature it outputs an electrical signal to Q1 which acts as a buffer which in turn turns off switch 48. The heat exchanger 22, however, is still quite hot. Heat is continuously harvested from the heat exchanger 22 without reinstigating the burner 20 until the heat exchanger 22 has cooled off to a point where the air passing through the plenum has dropped to a temperature which corresponds to that which is set via switches S1 and S2. When the probe 40 then senses this temperature the collector of Q1 the buffer then goes low to once again pass current through λ3 to activate the optical coupled switch 48 which turns on the solenoid 44. The gas burner 22 is burned for an increment of time in order to reheat the heat exchange 22 up to a temperature wherein it is capable of heating the air passing through the plenum 12 to the temperature turn off point set for the probe 40 via the switches S1 and S2.

It is apparent that by continually modulating the burner 12 off and on in accordance to the temperature of the air passing through the plenum 12, heat can be harvested from the heat exchanger 22 both when the burner 20 is on and when it is off. Normally without this invention a burner in a furnace 10 would remain in the on position at all times whenever air is flowing through the heat exchanger 22. However, after the heat exchanger 22 gets quite warm its efficiency drops and more and more of this heat would pass through the flue 14 to the atmosphere and be wasted.

In using the invention and by turning the burner 20 off when the heat exchanger gets hot additional heat is harvested from the heat exchanger 22 and not wasted up the flue 14 to increase the efficiency of operation of the furnace 10.

We claim:

1. A furnace system which comprises:

a space heater having a burner means for burning fuel, an electrically operated fuel valve means associated with said burner means for supplying fuel to said burner means and a heat exchange means for conducting heat from said burner means through a plenum to a space;

said fuel valve means including an A/C operated solenoid for controlling fuel flow;

a heat probe means for sensing a first temperature and a second temperature, said first temperature greater than said second temperature, said heat probe means located in said plenum in a position to sense the temperature of air passing from said heat exchange means into said plenum;

a control means for setting said first and said second temperatures, said control means electrically associated with said heat probe means and including a first temperature setting means and a hysteresis means, said first temperature setting means for setting said first temperature at at least two different values, said hysteresis means for setting a temperature differential between said first temperature and said second temperature whereby said second temperature is dependent on said first temperature and said second temperature can be set at at least two different values for each of said values of said first temperature;

an optical coupled switch having an input circuit and an output circuit, said output circuit consisting of a MOSFET transistor and a photovoltaic element electrically connected together, said MOSFET transistor directly electrically connected in series to said fuel valve means solenoid without any other intervening electrical components being located between said MOSFET transistor and said solenoid whereby said MOSFET transistor directly controls the A/C current through said fuel valve means solenoid, said input circuit consisting of a light emitting diode electrically isolated from both said photovoltaic element and said MOSFET transistor, said optical coupled switch including a light path between said light emitting diode and said photovoltaic element for conducting light from said light emitting diode to said photovoltaic element, said light emitting diode electrically connected to said heat probe means so as to receive an electrical signal from said heat probe means and in response to said electrical signal said light emitting diode emitting light through said light path to said photovoltaic element;

a latch means for fixing said optical coupled switch in a first switch position in response to said first temperature to disrupt said A/C current flow to said fuel valve means solenoid and for fixing said optical coupled switch in a second switch position in response to said second temperature to restore said A/C current to said fuel valve means solenoid, said latch means electrically associated with both said heat probe means and said input circuit of said optical coupled switch;

a first indicator means for indicating when said switch is in said first position, said first indicator means in electrical association with said switch;

a buffer means for operating said switch means in response to said electrical signal from said heat probe means, said buffer means including a transistor electrically associated with said heat probe means and said optical couple switch.

* * * * *